US009175844B2

(12) United States Patent
Mischel, Jr. et al.

(10) Patent No.: US 9,175,844 B2
(45) Date of Patent: Nov. 3, 2015

(54) MIRROR WITH LOCKABLE MOUNTING SYSTEM

(75) Inventors: James V. Mischel, Jr., Seattle, WA (US); James V. Mischel, Sr., Lynwood, WA (US); Patrick D. Erickson, Seattle, WA (US)

(73) Assignee: ELECTRIC MIRROR, LLC, Everett, WA (US)

( * ) Notice: Subject to any disclaimer, the term of this patent is extended or adjusted under 35 U.S.C. 154(b) by 406 days.

(21) Appl. No.: 12/352,453

(22) Filed: Jan. 12, 2009

(65) Prior Publication Data

US 2009/0250586 A1 Oct. 8, 2009

Related U.S. Application Data

(60) Provisional application No. 61/020,671, filed on Jan. 11, 2008.

(51) Int. Cl.

| | |
|---|---|
| ***A47G 1/16*** | (2006.01) |
| ***F21V 33/00*** | (2006.01) |
| ***A47G 1/02*** | (2006.01) |
| ***A47G 1/06*** | (2006.01) |

(52) U.S. Cl.

CPC ..... *F21V 33/004* (2013.01); *A47G 1/02* (2013.01); *A47G 1/0655* (2013.01); *A47G 1/16* (2013.01); *A47G 2200/08* (2013.01)

(58) Field of Classification Search

USPC ..... 248/466, 474, 488, 490, 497, 544, 489

See application file for complete search history.

(56) References Cited

U.S. PATENT DOCUMENTS

| | | | | |
|---|---|---|---|---|
| 1,138,552 | A | 5/1915 | Goddard | |
| 3,381,120 | A | 4/1968 | Fleisher et al. | |
| 4,187,630 | A | 2/1980 | Giulie | |
| 4,277,903 | A | 7/1981 | Crossot | |
| 4,336,574 | A | 6/1982 | Goodman | |
| 4,473,207 | A * | 9/1984 | Nascher | 248/490 |
| 4,922,384 | A | 5/1990 | Torrence | |
| 5,160,203 | A | 11/1992 | Viertel | |
| 5,367,802 | A | 11/1994 | Rosenberg | |
| 5,575,552 | A | 11/1996 | Faloon | |
| 6,172,613 | B1 | 1/2001 | DeLine | |
| 6,792,710 | B2 | 9/2004 | Whitlow | |
| 6,955,329 | B1 * | 10/2005 | Shieh | 248/466 |
| 7,419,129 | B2 * | 9/2008 | Kixmoeller | 248/488 |

(Continued)

OTHER PUBLICATIONS

"ACQUA," ASCOLights.co.uk, <http://web.archive.org/web/20040603034329/www.ascolights.co.uk/Bathroom_mirrors.html>, as early as Jun. 2004.

(Continued)

*Primary Examiner* — Bradley Duckworth

(74) *Attorney, Agent, or Firm* — Peloquin, PLLC; Mark S. Peloquin, Esq.

(57) ABSTRACT

A mirror assembly includes a mirror and a hanger assembly secured to the mirror. The hanger assembly has a hanger fitting that defines a plurality of apertures, and a locking element that is slidably coupled to the hanger fitting to be movable between a locked position and an unlocked position. The mirror assembly further includes a chassis having a plurality of support members sized and positioned to engage the plurality of apertures in the hanger fitting. When the locking element is in the locked position, the plurality of support members are prevented from disengaging the hanger fitting.

17 Claims, 13 Drawing Sheets

(56) References Cited

U.S. PATENT DOCUMENTS

| | | | | |
|---|---|---|---|---|
| D591,054 | S | 4/2009 | Erickson | |
| 2006/0207145 | A1 | 9/2006 | Kim | |
| 2010/0276562 | A1 * | 11/2010 | Nguyen | 248/488 |

OTHER PUBLICATIONS

"Circular Inspiration," ElectricMirror.com, <http://web.archive.org/web/20040107191514/www.electricmirror.com/Images/Lighting+Stations/Circular+Inspiration+Specification.pdf>, as early as Aug. 2003.

"Fusion," ElectricMirror.com, <http://web.archive.org/web/20030828072111/http://www.electricmirror.com/Images/Lighting%20Stations/Fusion%20Specification.pdf>, as early as Aug. 2003.

"Masterpiece," ElectricMirror.com, <http://web.archive.org/web/20030831074237/http://www.electricmirror.com/Images/Lighting%20Stations/MasterpieceSpecification.pdf>, as early as Aug. 2003.

Mischel Jr., J.V., and S. Yoon, "Backlit Mirror," U.S. Appl. No. 29/307,052, filed Mar. 27, 2008.

"Momentum," ElectricMirror.com, <http://web.archive.org/web/20030822110335/www.electricmirror.com/Images/Lighting+Stations/Momentum+Specification.pdf>, as early as Aug. 2003.

"Radiance," ElectricMirror.com, <http://web.archive.org/web/20030813193138/www.electricmirror.com/Images/Lighting+Stations/Radiance+Specification.pdf>, as early as Aug. 2003.

* cited by examiner

MIRROR WITH LOCKABLE MOUNTING SYSTEM

CROSS-REFERENCE(S) TO RELATED APPLICATION(S)

This application claims the benefit of U.S. Provisional Application No. 61/020,671, filed on Jan. 11, 2008, the disclosure of which is expressly incorporated by reference.

TECHNICAL FIELD

The disclosed subject matter relates generally to mirrors, and particularly to systems for mounting mirrors to a mounting surface

BACKGROUND

Some mirror assemblies include integrated electrical components, such as light sources, televisions, defogger assemblies, etc. The mirror assembly normally includes a mirror reversibly affixed to a chassis, wherein the chassis is suitably designed to be mounted to a wall. The electrical components are either secured within the chassis or mounted to the back of the mirror. This arrangement is a convenient space saving device as it embeds the electrical components into the existing space occupied by a mirror.

The mirror is typically secured to the chassis by a plurality of mounting brackets disposed on the chassis. The mounting brackets are adapted to engage a portion of the mirror, such as the mirror frame or a corresponding bracket attached to the rear surface of the mirror. To attach the mirror assembly to the wall, the chassis is first mounted to the wall. The mirror is then secured to the chassis with the brackets.

Mounting the mirror to the chassis in this manner has several drawbacks. For instance, it is desirable for the mirror to be demountable from the chassis to provide access to the electrical components. At the same time, it is desirable to secure the mirror to the chassis in a manner that prevents the mirror from becoming unintentionally disengaged from the chassis. It is therefore desirable to have a system for demountably coupling the mirror to the chassis and selectively locking and unlocking the mounted mirror to the chassis.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A mirror assembly comprises a mirror, a hanger assembly secured to the mirror, and a chassis. In one embodiment, the hanger assembly includes a hanger fitting having a plurality of apertures disposed therein. The hanger assembly further includes a locking element slidingly coupled to the hanger fitting so that the locking element is movable between a locked position and an unlocked position. The chassis includes a plurality of support members sized and positioned to engage the apertures in the hanger fitting. When the support members are engaged with the apertures, and the locking element is in the locked position, the support members are prevented from disengaging the hanger fitting.

In a second embodiment the hanger assembly defines a plurality of holes and includes a locking element that is selectively movable between a locked position and an unlocked position. The chassis includes a plurality of hooks sized and positioned to engage the plurality of holes to support the mirror. One of the hooks is retained in its respective hole by the locking element when the locking element is in the locked position.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

For clarity in the following description, directional terms such as vertical, horizontal, downwardly, upwardly, forward, rear, etc. have been used to describe several suitable embodiment of a mirror assembly 100, wherein the mirror assembly is mounted to a vertical mounting surface, such as a wall, a door, etc., with the reflective surface of the mirror facing away from the mounting surface. However, it will be appreciated that the mirror assembly of the presently claimed subject matter may be mounted in any orientation, and thus, the directional terms will change accordingly. Therefore, such terms should be viewed as merely descriptive and non-limiting.

Figure 1:
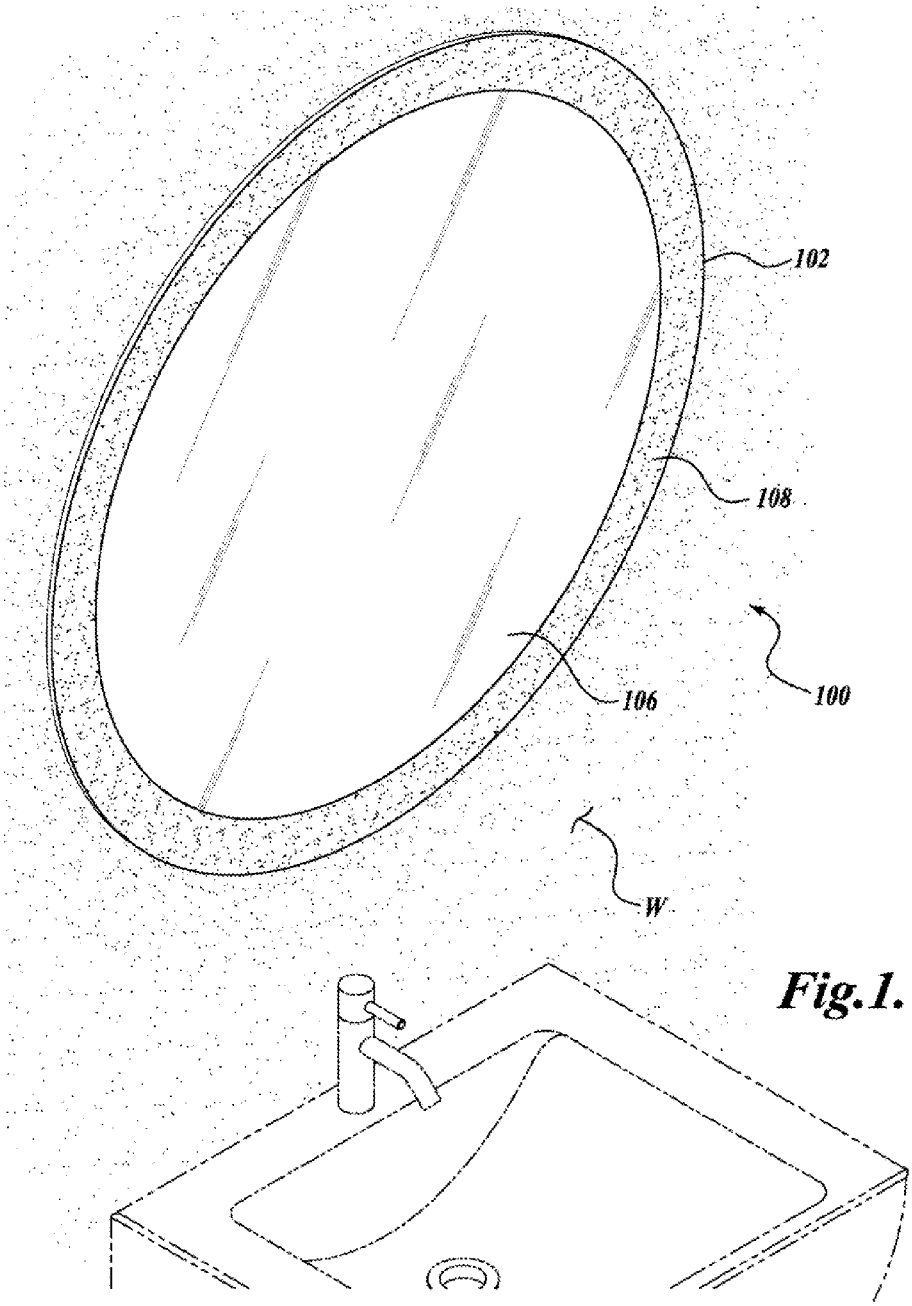
FIG. 1 is a front isometric view of an exemplary embodiment of a mirror assembly.
Figure 2:
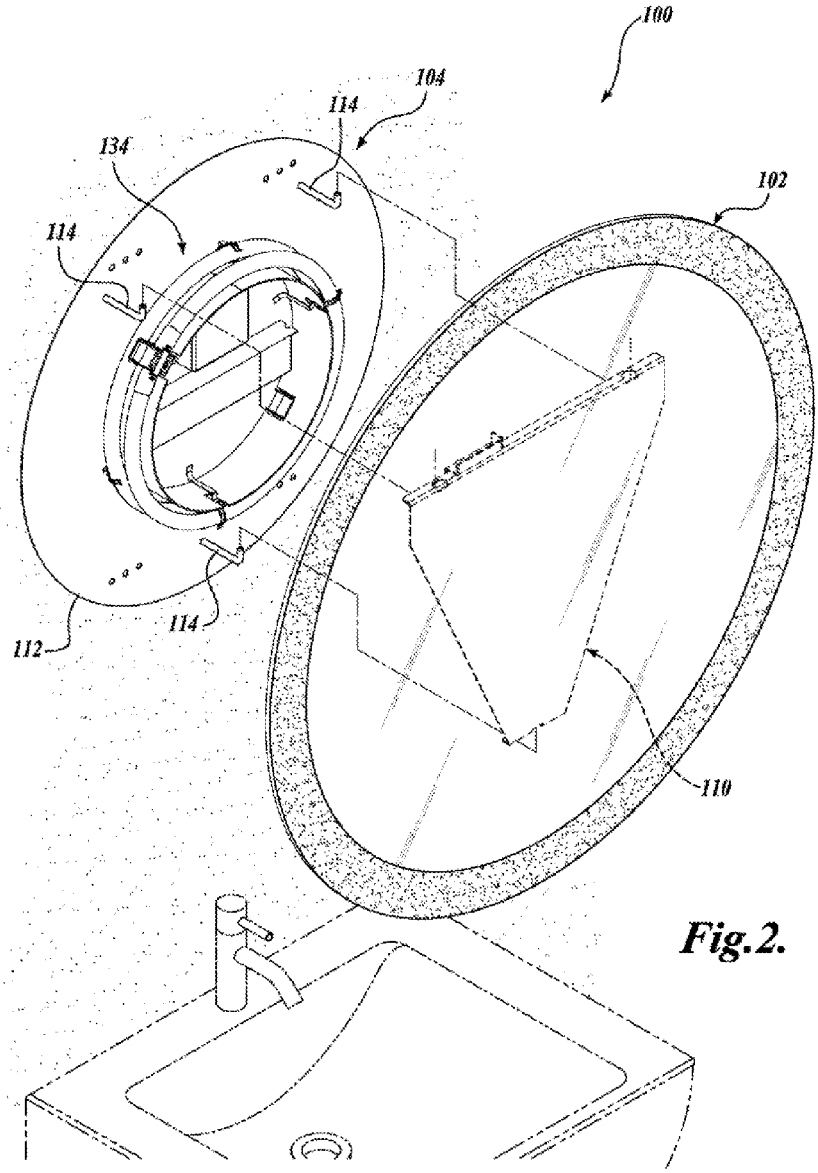
FIG. 2 is a partially exploded front isometric view of the mirror assembly shown in FIG. 1.

A mirror assembly 100 constructed in accordance with one embodiment of the present disclosure may be best understood by referring to FIGS. 1 and 2. The mirror assembly 100 is mounted a wall W or other suitable mounting surface, and includes a mirror 102 removably attached to a chassis 104. The mirror has a reflective surface 106 and may include one or more translucent or transparent portions 108 that are illuminated by an optional light fixture 134 disposed behind the mirror. A hanger assembly 110 is secured to the mirror 102 by adhesives, fasteners, or other suitable means to provide a coupling interface to attach the mirror 102 to the chassis 104. To mount the mirror assembly 100 to the wall W, the chassis 104 is mounted to the wall W, and the hanger assembly 110 is removably coupled to the chassis 104 to attach the mirror 100 to the chassis 104 and, therefore, the wall W.

Figure 3:
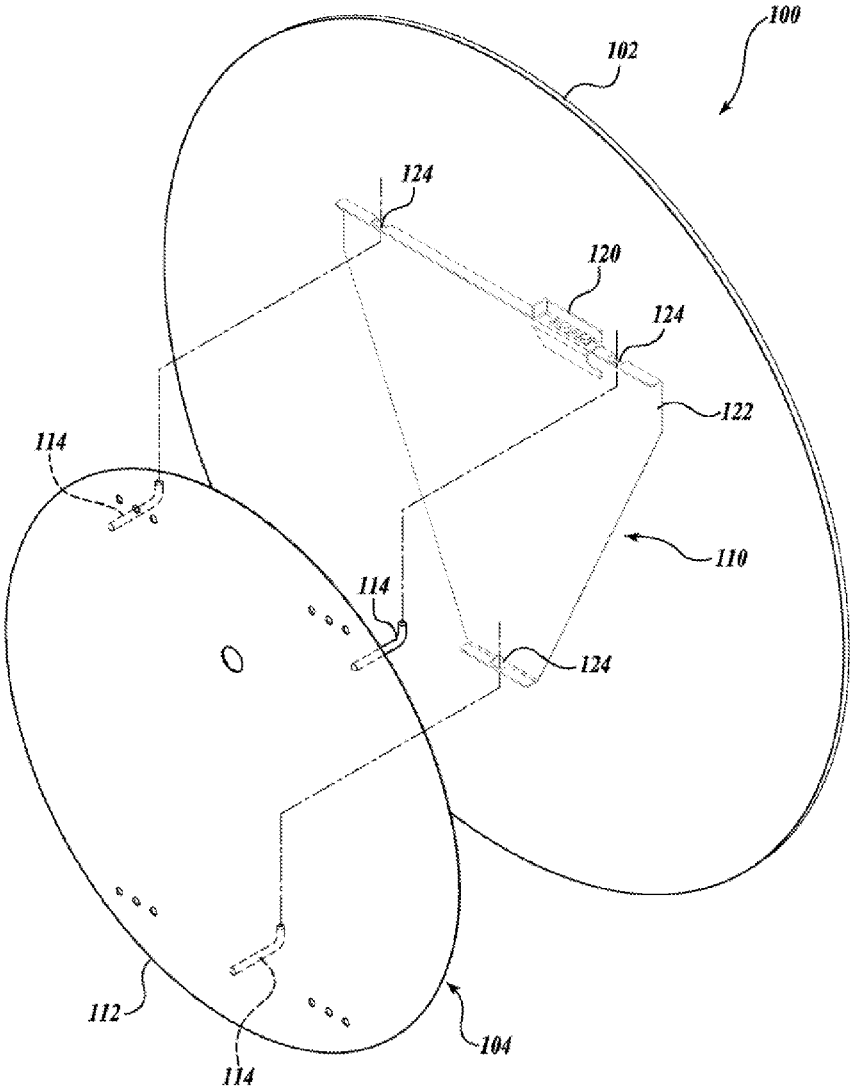
FIG. 3 is a partially exploded rear isometric view of the mirror assembly shown in FIG. 1.
Figure 4:
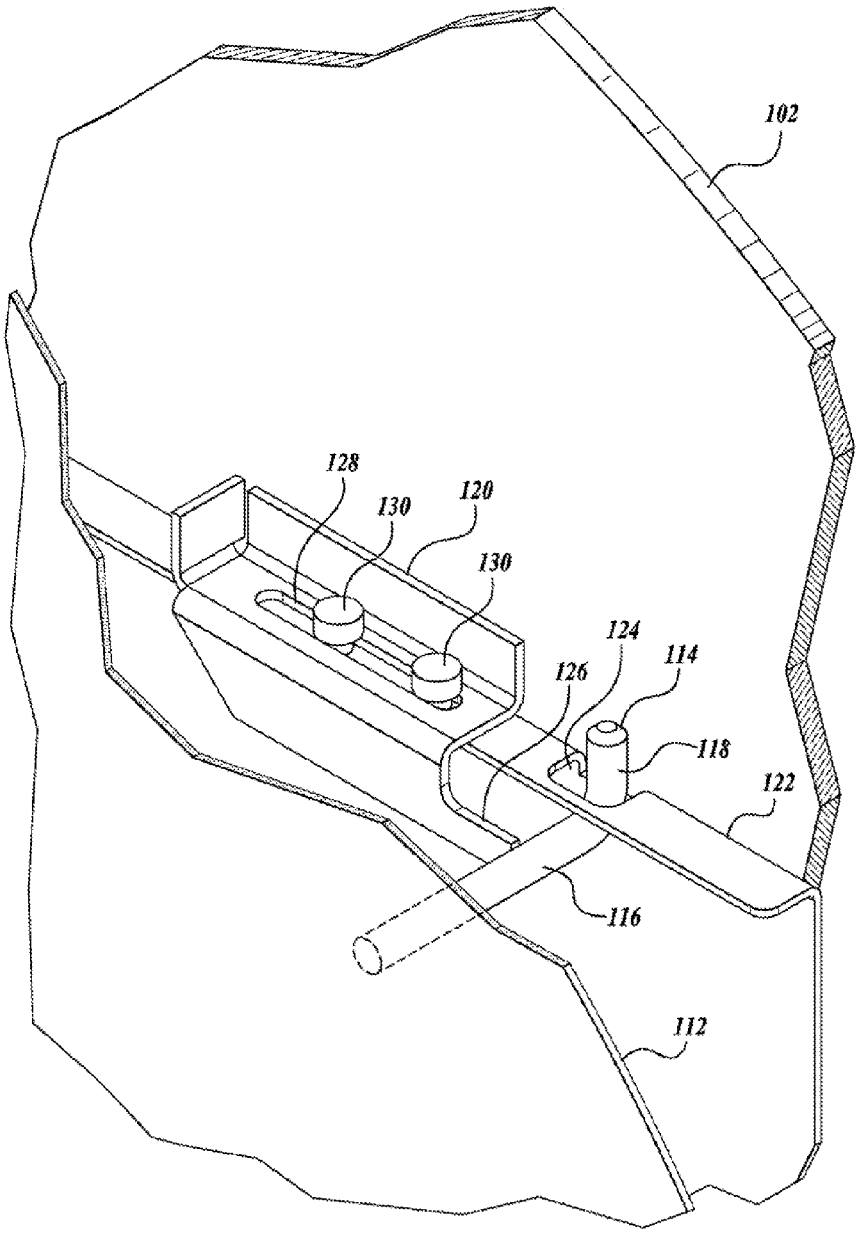
FIG. 4 is rear isometric, partial cut-away view of a locking feature of the mirror assembly shown in FIG. 1 with the locking feature in an unlocked position.
Figure 5:
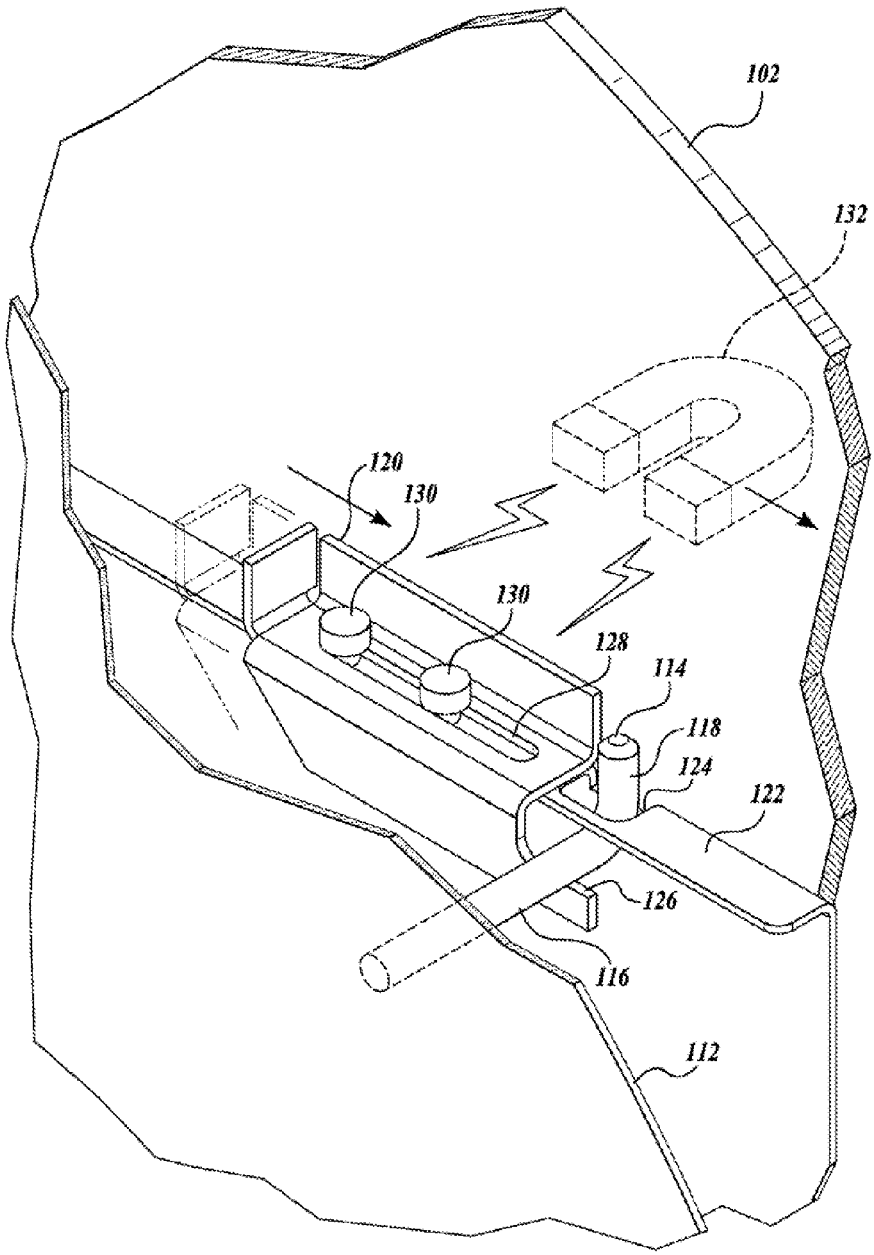
FIG. 5 is rear isometric, partial cut-away view of the locking feature shown in FIG. 4 with the locking feature in a locked position.

Referring to FIGS. 3-5, the chassis 104 includes a backing plate 112 with a plurality of support members 114 attached thereto. The backing plate 112 may be directly secured to the wall W using fasteners, adhesives, etc. The backing plate 112 may also be attached to the wall W indirectly via other intermediate structure. A plurality of support members 114 extend from the backing plate 112 to engage the hanger assembly 110. In the illustrated embodiment, the support members 114 are L-shaped hooks having a horizontal portion 116 extending in a direction approximately perpendicular to the backing plate 112, and a vertical portion 118 extending upward from the end of the horizontal portion 116 that is opposite the backing plate 112. It should be appreciated that the shape and orientation of the support members 114 are not limited to those shown in the illustrated embodiments. In alternate embodiments, the support members 114 may be C-shape hooks, angled brackets, or any other suitable form for engaging the hanger assembly 110 to support the mirror 102. Further, the support members 114 are not limited to extending from the backing plate 112 in a perpendicular direction, but may extend at any suitable angle relative to the mounting surface.

As best shown in FIG. 3, the mirror assembly of the illustrated embodiment includes three support members 114 arranged to form a triangular pattern, with two upper support members 114 arranged along a horizontal line, and a lower support member 114 disposed below the upper support members 114. The illustrated arrangement allows for the hanger assembly 110 to be secured to the chassis 104 with a locking element 120 that lockingly engages a single support member 114. However, alternate embodiments having various numbers of support members 114 arranged in different patterns are contemplated and should be considered within the scope of the present disclosure.

Still referring to FIG. 3, the hanger assembly 110 includes a hanger fitting 122 formed to have a plurality of apertures 124 sized and positioned to receive the plurality of support members 114 associated with the backing plate 112. In the illustrated embodiment, the apertures 124 are disposed in upper and lower horizontal flanges of the hanger fitting 122 and correspond to the three L-shaped support members 114. To mount the mirror 102 to the chassis 104, the mirror 102 and attached hanger assembly 110 are moved relative to the chassis 104 so that the vertical portions 118 of the support elements 114 engage the corresponding apertures 124 in the hanger fitting 122 from below. In the mounted position, the horizontal portions 116 of the support elements 114 engage the flanges of the hanger fitting 122 to support the mirror 102 in the vertical direction, while the vertical portions 118 of the support elements 114 engage the edges of the apertures 124 to prevent movement of the mirror 102 in the horizontal direction.

With the mirror 102 mounted to the chassis 104, it is desirable to secure the mirror 102 to prevent the mirror 102 from becoming disengaged from the chassis 104. Referring to FIGS. 4 and 5, the locking element 120, which is movably coupled to the hanger fitting 122 in the disclosed embodiment, is selectively movable between an unlocked position (FIG. 4) and a locked position (FIG. 5). In the unlocked position, the locking element 120 does not obstruct the apertures 124 of the hanger fitting 122, allowing the support elements 114 to freely engage and disengage the hanger assembly 110 to mount and demount the mirror 102. In the locked position, a portion of the locking element 120 extends under one of the apertures to prevent a support element 114 disposed within the aperture 124 from disengaging the hanger assembly 110, thereby locking the mirror 102 to the chassis 104. In the illustrated embodiment, a tab 126 extends beneath the horizontal portion 116 of the support element 114 when the locking element 120 is in the locked position to prevent the mirror 102 from moving up relative to the chassis 104. When the locking element 120 is in the unlocked position, the tab 126 does not extend beneath the support element 114, which is therefore free to engage or disengage the aperture 124 in the hanger fitting 122.

Still referring to FIGS. 4 and 5, the locking element 120 is coupled to the hanger fitting 122 to be movable between the locked position and the unlocked position. In the disclosed embodiment, the locking element 120 includes an elongate slot 128. A pair of pins 130 are fixedly coupled to the hanger fitting 122 and extend through the slot 128. The pins 130 cooperate with the slot 128 to slidingly couple the locking element 120 to the hanger fitting 122. Alternate couplings between the locking element 120 and the hanger fitting are contemplated and should be considered within the scope of the disclosed subject matter. In one alternate embodiment, the pins 130 are fixedly coupled to the locking element 120 and extend through an elongate slot 128 disposed in the hanger fitting 122 to slidingly couple the locking element 120 to the hanger fitting 122. Referring to FIGS. 11*a* through FIG. 11*d*, in a second alternate embodiment, the locking element 120 includes a C-shaped channel corresponding to a T-shaped featured included on the hanger fitting 122. The T-shaped feature of the hanger fitting 122 nests within the C-shaped channel of the locking element 120 to slidingly couple the locking element 120 to the hanger fitting 122. It should be appreciated that the locking element can be slidingly coupled to the hanger fitting 122 using a number of suitable configurations, and such configurations should be considered within the scope of the disclosed subject matter.

In one contemplated embodiment, the locking element 120 is movable between the locked and unlocked position by an installer placing his or her hand between the mirror 102 and the chassis 104 to manually move the locking element 120. Alternately, if access to the locking element 120 is limited, a tool may be inserted between the mirror 102 and the chassis 104 to move the locking element 120 back and forth between the locked and unlocked positions. In yet another embodiment, the locking element is formed from a magnetic material or has a magnetic material attached to it. As shown in FIG. 5, the locking element 120 is movable by moving a magnet 132 near the reflected surface of the mirror 102, eliminating the need for access to the area between the mirror 102 and the chassis 104.

In addition to providing a means to attach the mirror 102 to the wall, the chassis 104 can serve several other functions. For example, in the embodiment shown in FIGS. 6-10, the chassis 104 also houses various mirror electrical components, such as a light fixture 134 and associated electrical components. In the illustrated embodiment, the electrical components include an electrical ballast 136 and a power cover 138 for a terminal box (not shown). The light fixture 134 and associated components are secured to the chassis 104 to illuminate selectively at least a portion of the wall W to which the mirror assembly 100 is mounted, and/or to illuminate selectively any transparent or translucent portions 108 of the mirror 102. In the disclosed embodiment, the electrical ballasts 36 and power cover 138 are secured directly to the chassis 104 with suitable fasteners such as screws, adhesive, etc.

Figure 6:
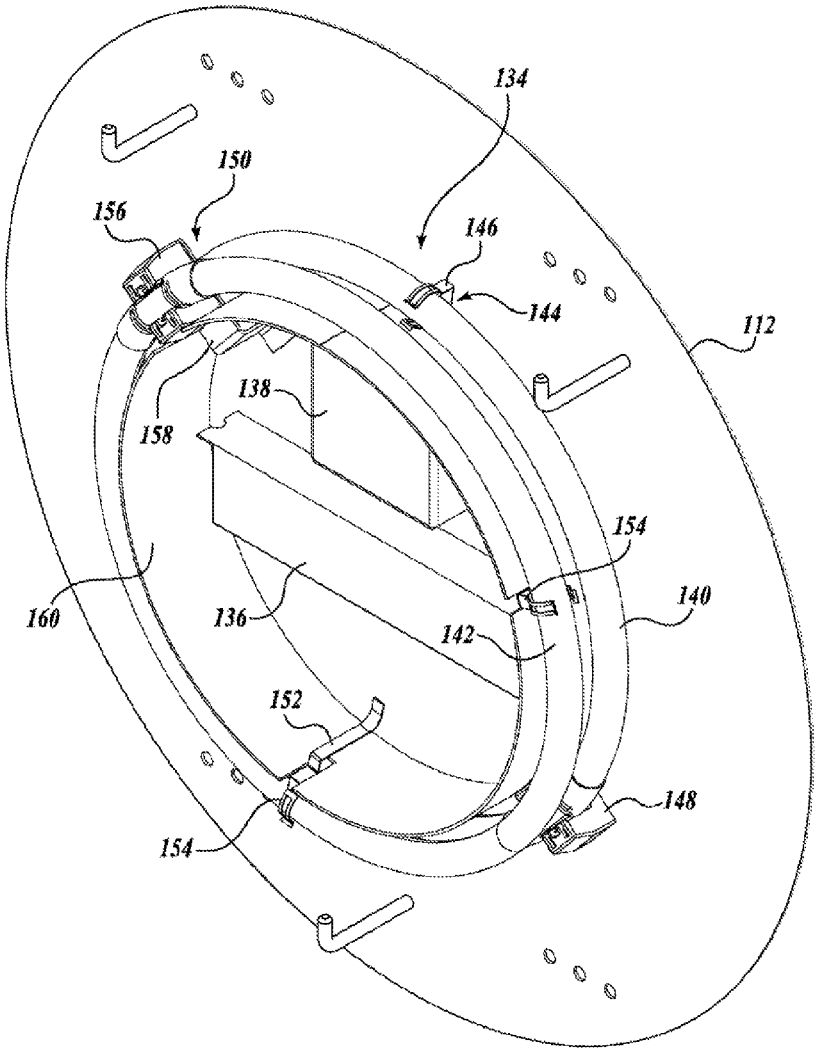
FIG. 6 is a front isometric view of a light fixture of the mirror assembly shown in FIG. 1.
Figure 7:
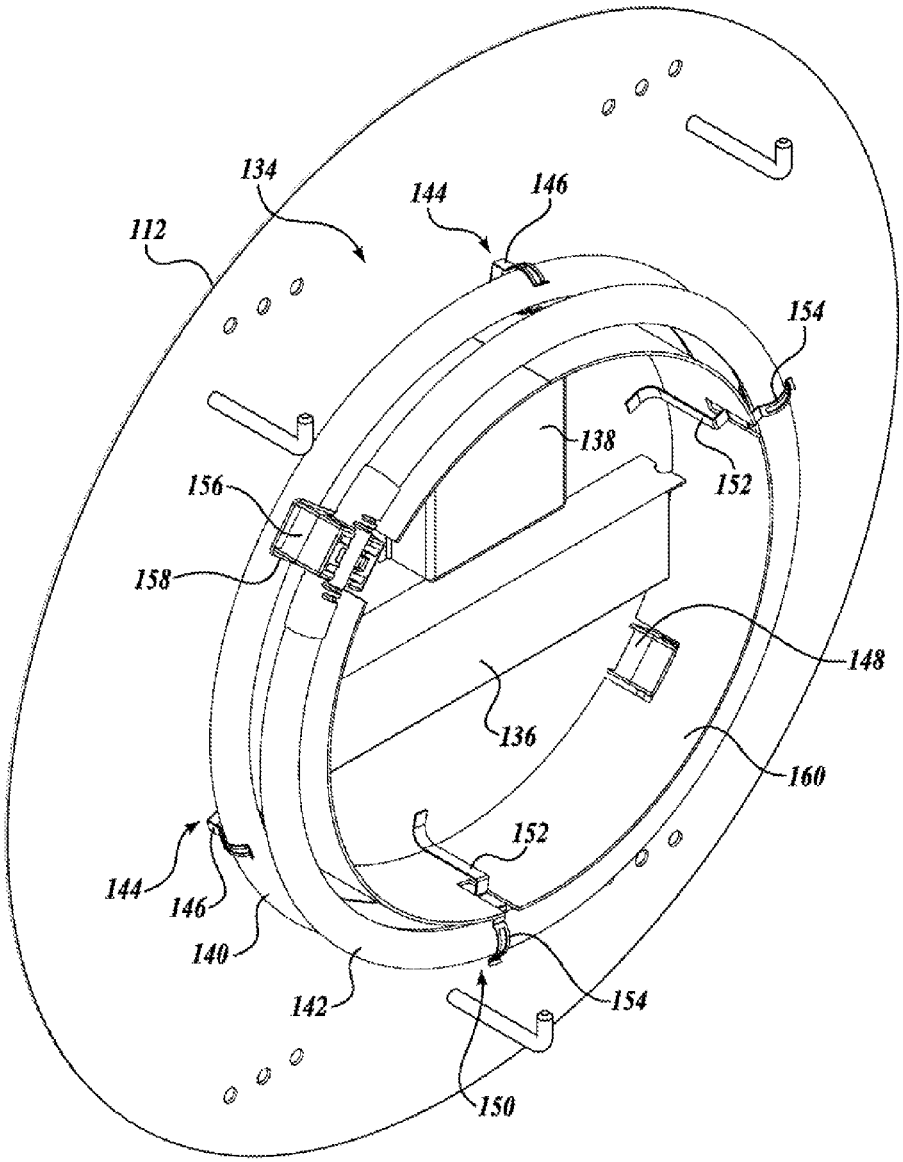
FIG. 7 is a front isometric view of the light fixture shown in FIG. 6.
Figure 8:
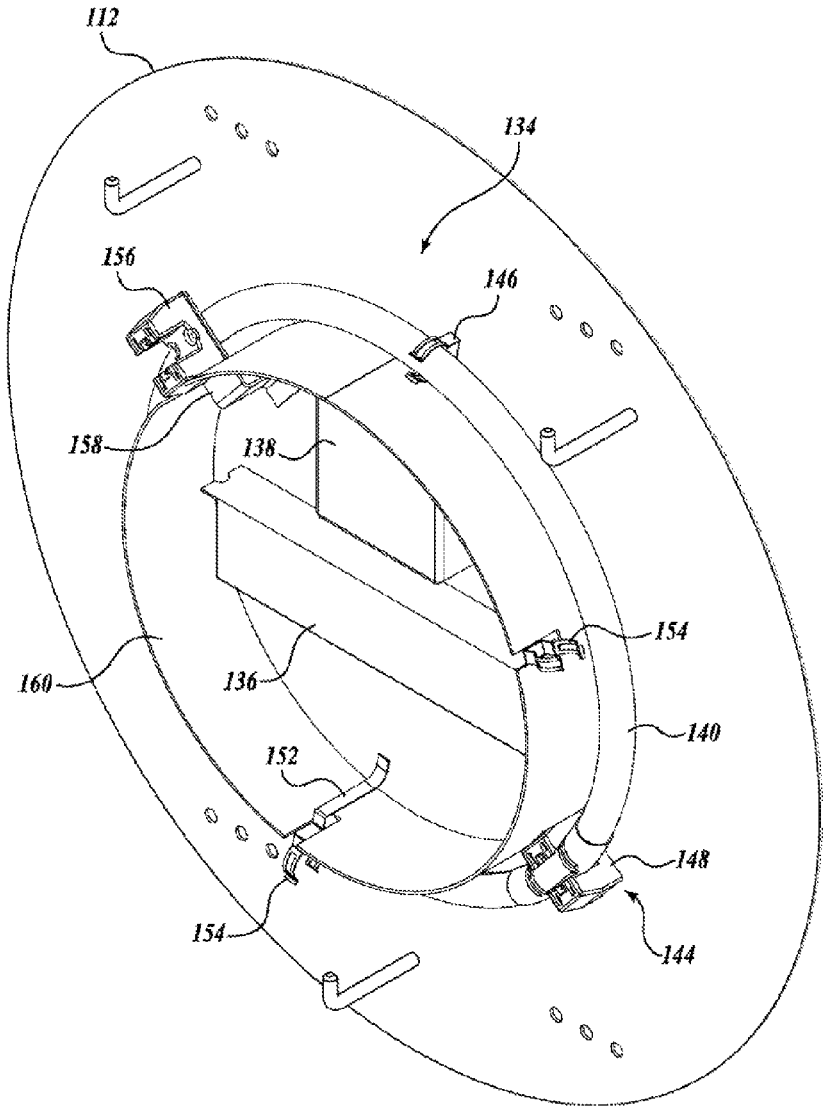
FIG. 8 is a front isometric view of the light fixture shown in FIG. 6 with a lamp removed.

As shown in FIGS. 6-8, the light fixture 134 includes a first lamp 140 and a second lamp 142. In the illustrated embodiment, the first and second lamps 140, 142 are circular fluorescent lamps having similar diameters. The first and second lamps 140, 142 are exemplary, and it is contemplated that the disclosed light fixture 134 can include suitable lamps of various numbers, shapes, sizes and types. The first lamp 140 is removably coupled to the backing plate 112 by a first lamp support 144. The first lamp support 144 includes a plurality of retainer elements 148 coupled to the backing plate 112. The retainer elements 148 engage the first lamp 140 to releasably attach the first lamp 140 to the backing plate 112. The first lamp support 144 further includes a support fitting 148 coupled to the backing plate 112. The support fitting 148 is releasably couplable to the first lamp 140. In addition to releasably attaching the first lamp 140 to the backing plate 112, the support fitting 148 also provides electrical power to the first lamp 140 in order to illuminate the first lamp 140. Although the illustrated embodiment shows a first lamp support 144 having two retainer elements 146 and a support element 148 arranged to be approximately equidistant around the circumference of the first lamp 140, it should be apparent that other configurations are possible, wherein the number, type, and placement of the retainer elements 146 and support element 148 vary according to the type and placement of the first lamp 140. Such alternate configurations should be considered within the scope of the present disclosure.

The second lamp 142 is removably coupled to the backing plate 112 by a second lamp support 150. As shown in FIGS. 6 and 7, when attached to the backing plate 112, the second lamp 142 is offset from the first lamp 140 and from the backing plate 112 so that the first lamp 140 is disposed between the second lamp 142 and the backing plate 112. Further, the first and second lamps 140, 142 are positioned to have a common center axis, i.e., the positions of the first and second lamps 140, 142 differ only in the distance by which each is offset from the backing plate 112. Because the first lamp 140 is disposed between the second lamp 142 and the backing plate 112, the second lamp 142 must be removed to allow the first lamp 140 to be removed. Alternate embodiments are contemplated in which the position of the first and second lamps 140, 142 vary relative to the backing plate 112 and to each other, wherein the second lamp 142 impedes removal or installation of the first lamp 140. Such embodiments should be considered within the scope of the present disclosure.

Referring to FIGS. 6-8, the second lamp support 150 includes a plurality of flexible clips 152 attached at a first end to the backing plate 112. The flexible clips 152 may be attached to the backing plates by welding, adhesives, fasteners, or any suitable means. The flexible clips 152 are preferably formed from sheet metal, although it is contemplated that the clips may be formed from other materials, such as polymers, composites, or other materials having suitable strength, hardness, and elasticity. A retainer element 154 is attached to a second end of each flexible clip 152 and engages the second lamp 142 to releasably attach the second lamp 142 to the backing plate 112. The retainer elements 154 are be attached to the flexible clips 152 using fasteners, adhesives, welds, or any other suitable means. Alternately, the retainer elements 154 can be integral to the flexible clips 152.

As shown in FIGS. 6 and 8, the second lamp support 150 further includes a support fitting 156 mounted to the backing plate 112 with a bracket 158. Similar to the support fitting 148 of the first lamp support 144, the support fitting 156 of the second lamp support 150 is couplable to the second lamp 142 to releasably attach the second lamp 142 to the backing plate 112 and to provide electrical power to the second lamp 142 so that the second lamp 142 can be selectively illuminated. The bracket 158 is preferably formed from sheet metal, but can alternately be formed from a polymeric material, or any other suitable material. The bracket 158 can be attached to the second lamp support 150 and to the backing plate 112 using fasteners, adhesive, or any other suitable means.

The illustrated embodiment includes an optional support ring 160 attached to the backing plate 112. The support ring 160 is formed from sheet metal into a ring having a diameter smaller than those of the first and second lamps 140, 142 so that the support ring 160 extends through the center portions of the first and second lamps 140, 142. The support ring is attached to the backing plate 112 by welding, adhesives, or any other suitable means. The flexible clips 152 and the bracket 158 of the second lamp support 150 are attached to the portion of backing plate 112 that is within the perimeter of the support ring 160. Each flexible clip 152/retainer element 154 combination extends outwardly beyond the perimeter of the support ring 160 through slots 162 disposed in the support ring 160 to engage the second lamp 142 at a location outside of the support ring 160. Similarly, the bracket 158/support fitting 156 combination also extends through a slot 162 in the support ring 160 to engage the second lamp 142 at a location outside of the support ring 160.

Figure 9:
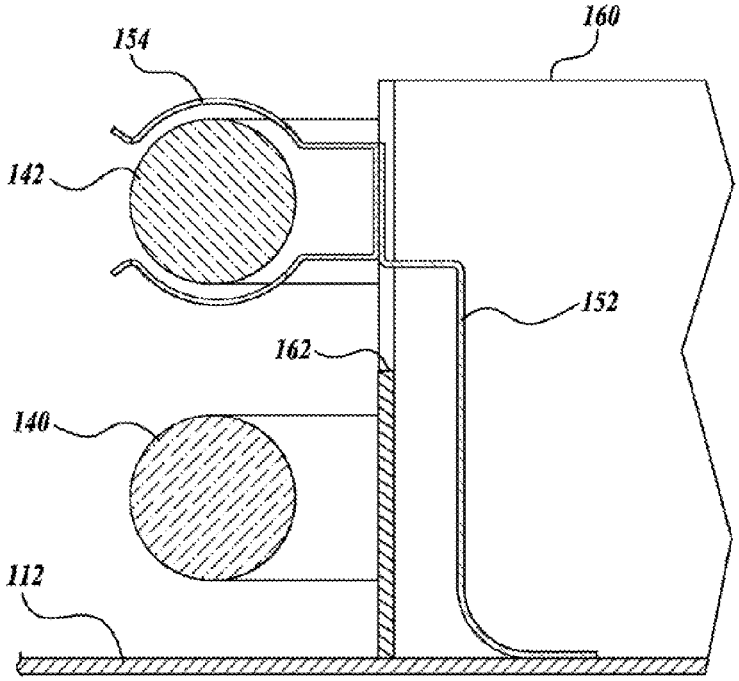
FIG. 9 is a partial section view of the light fixture shown in FIG. 6 with a lamp support in a support position.
Figure 10:
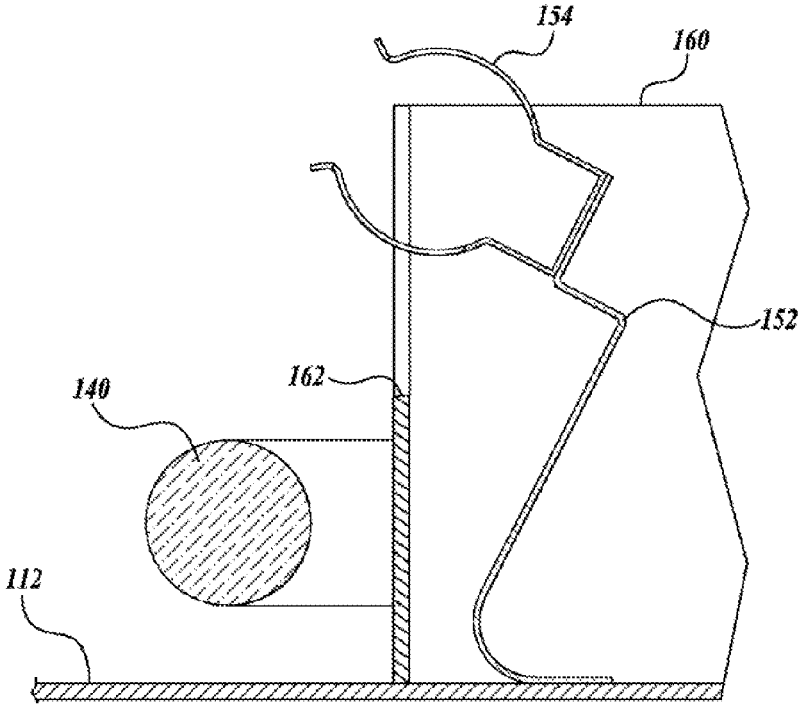
FIG. 10 is a partial section view of the light fixture shown in FIG. 9 with the lamp support in a release position.
Figure 11A:
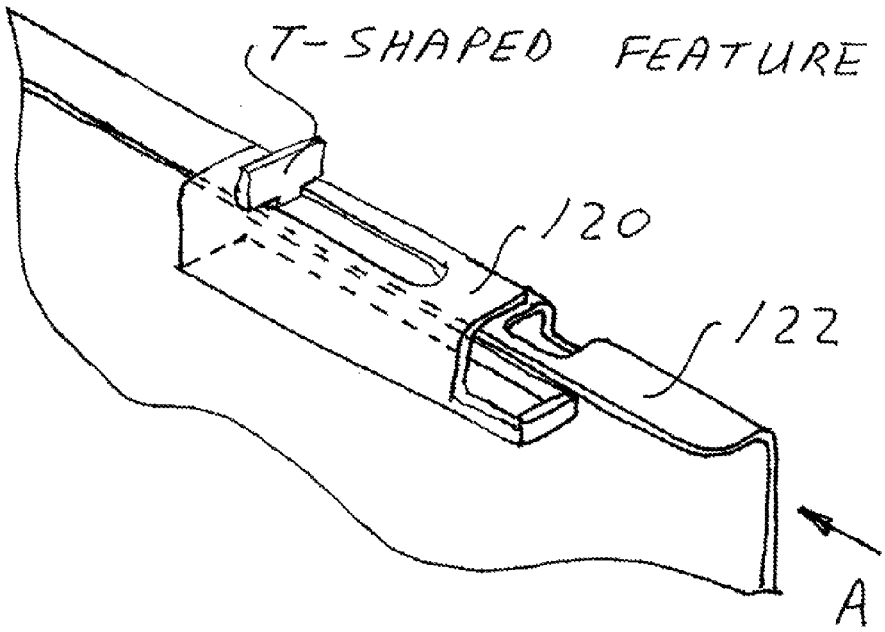
FIGS. 11*a*-11*d*. illustrate C-shaped channel and T-shaped features, according to embodiments of the invention.
Figure 11A:
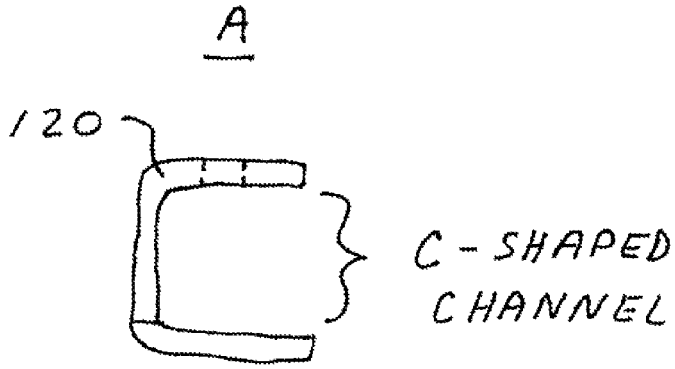
Figure 11B:
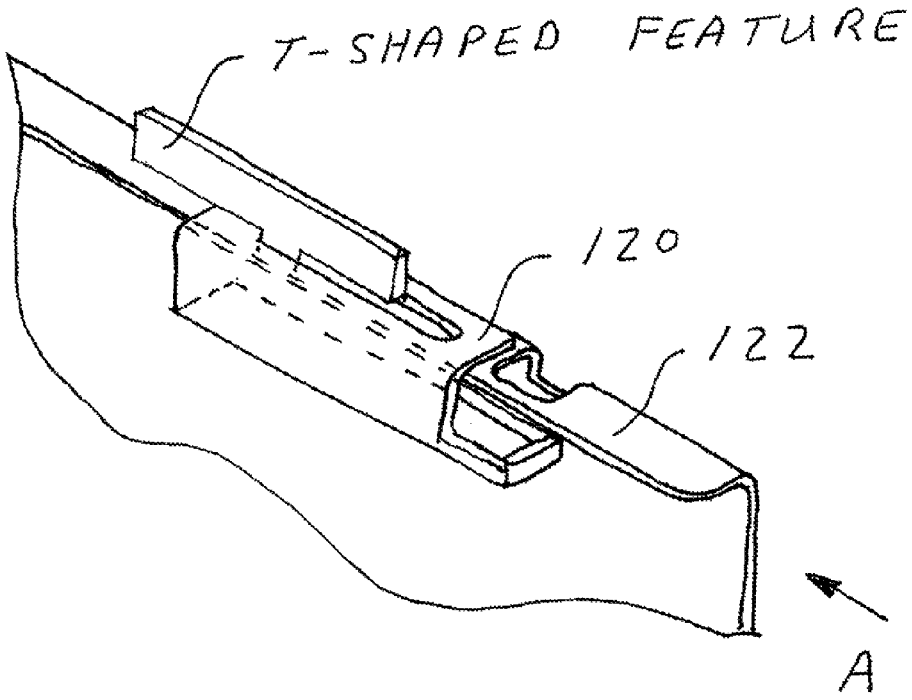
Figure 11B:
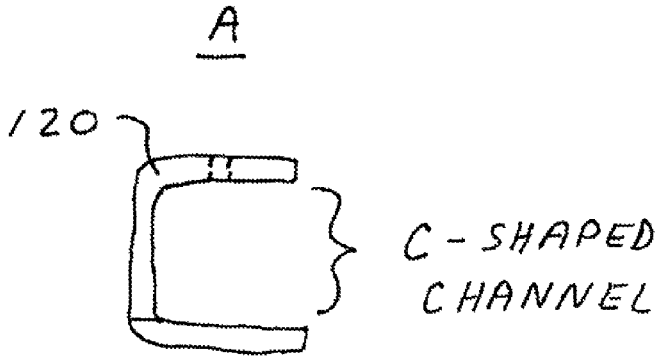
Figure 11C:
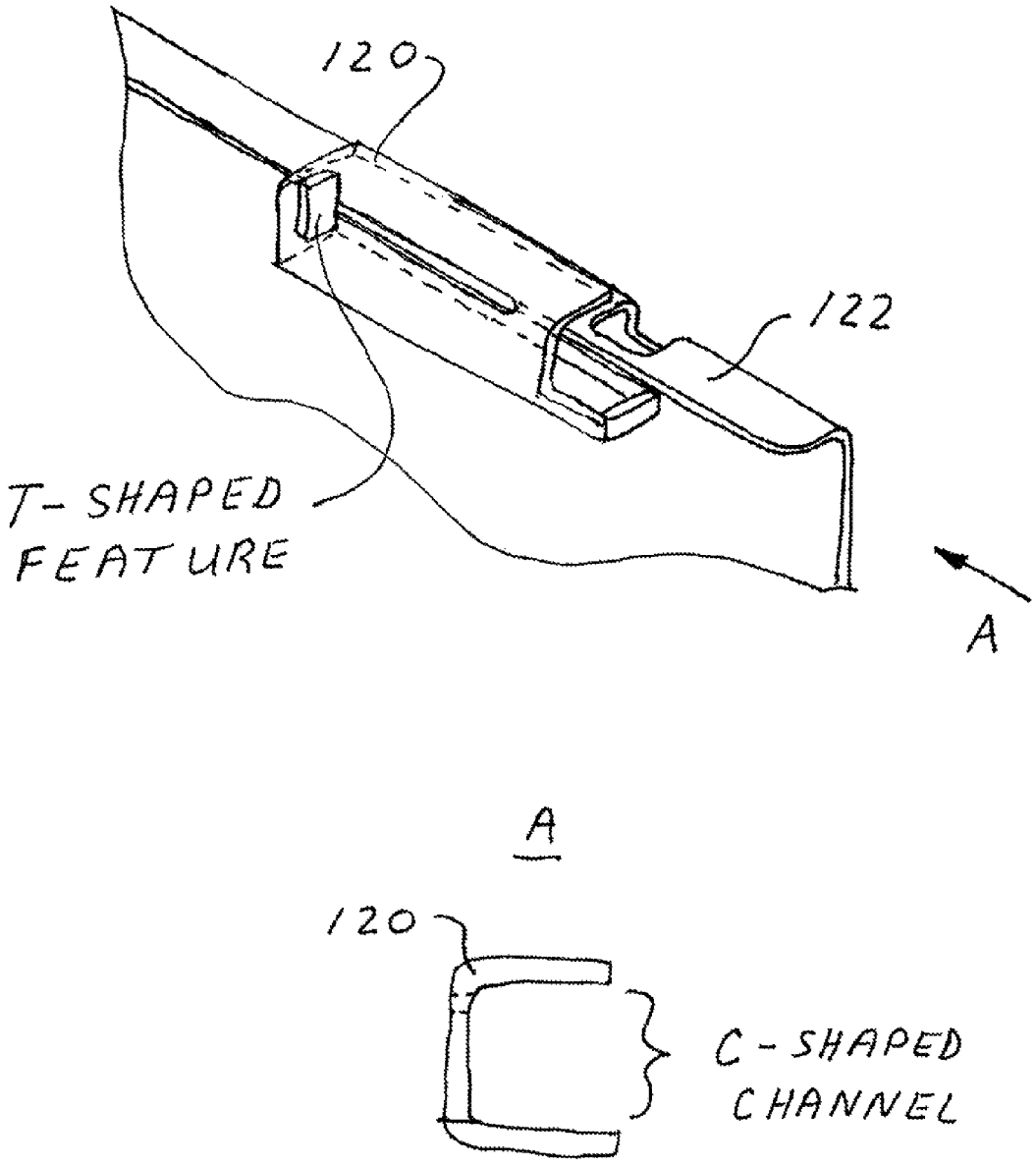
Figure 11D:
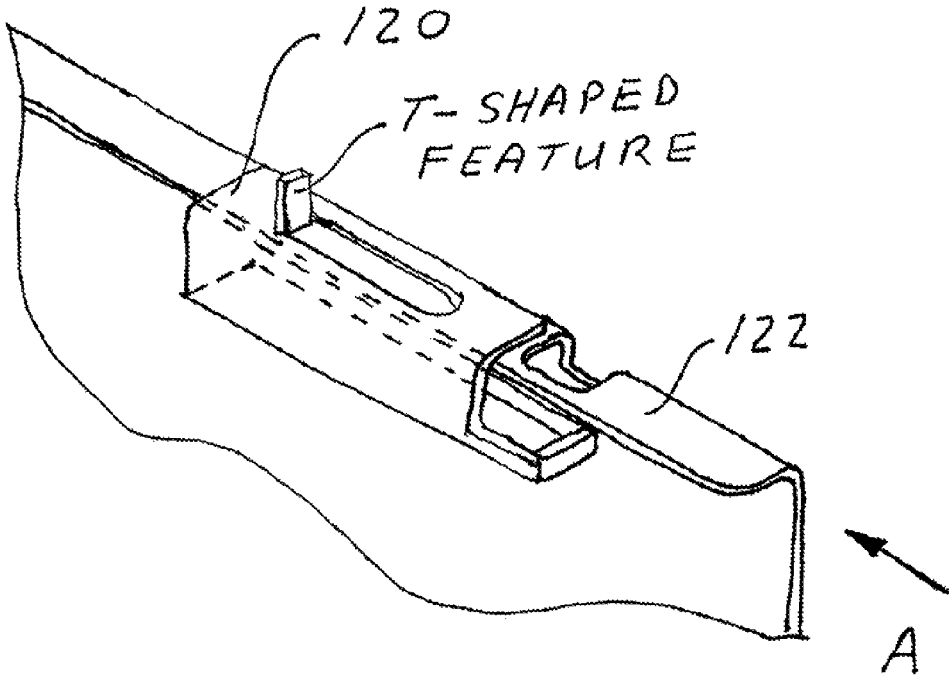
Figure 11D:
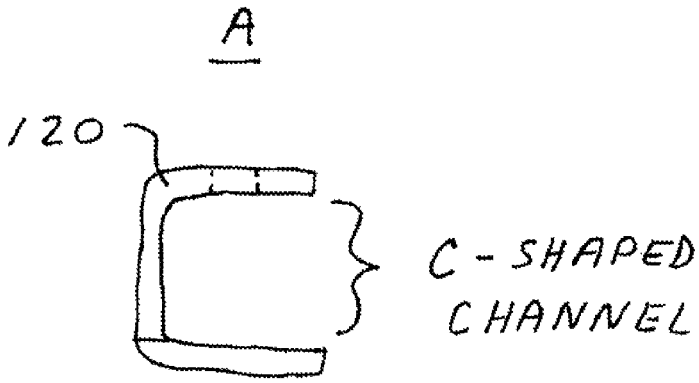

As shown in FIGS. 9 and 10, the support ring 160 limits the amount by which the flexible clips 152 can be flexed. More specifically, the support ring 160 limits the range through which the flexible clips 152 can flex outwardly, while allowing the flexible clips 152 to flex inwardly without contacting the support ring 160. The sides of the slots 162 in the support ring 160 also limit the lateral movement of the flexible clips 152 to add lateral stability to the second lamp support 150. Further, the edge of the ring protects the second lamp 142 from potential damage when the mirror 102 is mounted to the chassis by providing an edge that will contact the mirror 102 before the mirror contacts the second lamp 142.

The illustrated support ring 160 is an exemplary embodiment. Other embodiments are contemplated wherein the support ring has different configurations, such as a plurality of brackets, a molded polymeric fitting, or any other suitable component. Such alternate configurations should be considered within the scope of the present disclosure.

The second lamp support 150 has a lamp support position (state), shown in FIG. 9, and a release position (state), shown in FIG. 10. In the lamp support position, the flexible clip 152 is positioned so that the retainer element 154 engages the second lamp 142 to support the second lamp 142 in the installed position. The flexible clip may be in a neutral (unflexed) or slightly preloaded state. In the lamp support position, both the second lamp 142 and the second lamp support 150 obstruct removal or installation of the first lamp 140.

FIG. 10 shows the lamp in a release position. With the first lamp 140 removed, the flexible clips 152 are elastically deformed inwardly, i.e., toward the center of the support ring 160, by applying a biasing force to the clips. Deforming the flexible clips in this manner moves the retainer elements 154 of the second lamp support 150 out of the installation/removal path of the first lamp 140. Because the flexible clips 152 are elastically deformed, the clips return to their previous neutral (unflexed) state when the biasing force is removed.

To replace the first lamp 140, the second lamp 142 is demounted from the second lamp support 150. A biasing force is applied to the flexible clips 152 of the second lamp support 150 to move the retainer elements 154 out of the installation/removal path of the first lamp 140. The first lamp 140 is then demounted from the first lamp support 144 and lifted over the support ring 160. Next, a replacement first lamp 140 is moved down over the support ring 160 and mounted to the first lamp support 144. The biasing force is removed from the flexible clips 152, and the flexible clips 152 return to their neutral position, allowing the second lamp 142 to be mounted to the second lamp support 150.

While illustrative embodiments have been illustrated and described, it will be appreciated that various changes can be made therein without departing from the spirit and scope of the invention.

The embodiments of the invention in which an exclusive property or privilege is claimed are defined as follows:

1. A mirror assembly, comprising:

(a) a mirror;

(b) a hanger assembly secured to the mirror, the hanger assembly comprising:

(i) a hanger fitting defining a plurality of apertures; and (ii) a locking mg element slidably coupled to the hanger fitting and movable between a locked position and an unlocked position: and (c) a chassis, the chassis comprising a plurality of support members sized and positioned to engage the plurality of apertures, wherein when the locking element is in the locked position, the plurality of support members are prevented from disengaging the hanger fitting.

2. The mirror assembly of claim I, wherein the locking element: is slidably coupled to the hanger fitting.

3. The mirror assembly of claim 2, the hanger assembly further comprising a pin, and the locking element further comprising an elongate slot, wherein the pin extends through the slot to slidably retain the locking element.

4. The mirror assembly of claim 3, wherein the pin is fixedly coupled to the hanger fitting.

5. The mirror assembly of claim 3, the hanger further comprising a second pin that extends through the slot.

6. The mirror assembly of claim 5, wherein the first and second pins are fixedly coupled to the hanger fitting.

7. The mirror assembly of claim 1, wherein at least one of the support members is a hook.

8. The mirror assembly of claim 7, wherein the hook comprises:

(a) a horizontal portion extending from backing plate; and (b) a vertical portion extending upward from the horizontal portion.

9. The mirror assembly of claim 8, wherein the vertical portion of the hook extends upward through one of the plurality of apertures, the locking element engaging a lower portion of the hook in the locked position to prevent the vertical portion from disengaging the one of the plurality of apertures.

10. The mirror assent of claim 1, wherein the locking element comprises at magnetic material.

11. The mirror assembly of claim 10, wherein the locking element is selectively movable by moving a magnet proximate to the locking element.

12. The mirror assembly of claim 11, wherein the mirror is positioned between the locking element and the magnet.

13. The mirror assembly of claim 1, wherein the chassis comprises three support members disposed in a triangular arrangement.

14. A mirror assembly, comprising:

(a) a mirror;

(b) a hanger assembly secured to the mirror and defining a plurality of holes, the hanger assembly comp sing a locking element selectively movable between a locked position and an unlocked position: and (c) a chassis comprising a plurality of hooks sized and positioned to engage the plurality of holes to support the mirror one of the plurality of hooks being retained in one of the plurality of holes by the locking element when in the locked position to removably couple the chassis to the hanger assembly.

15. The mirror assembly of claim 14, wherein the locking element is selectively movable by moving a magnet proximate to the locking element.

16. The mirror assembly of claim 15, wherein the mirror is disposed between the locking element and the magnet.

17. The mirror assembly of claim 14, the locking element comprising a tab extending under the one of the plurality of holes when the locking element is in the locked position to prevent the one of the plurality of hooks from disengaging the one of the plurality of holes.

* * * * *